US006428228B1

(12) United States Patent
McKay et al.

(10) Patent No.: US 6,428,228 B1
(45) Date of Patent: Aug. 6, 2002

(54) REMOVABLE PAPER MODULE FOR AN ORTHOGONAL INKJET PRINTER

(75) Inventors: Kerry N. McKay, San Diego; Daniel S. Kilne, Encinitas, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/453,149

(22) Filed: Dec. 2, 1999

(51) Int. Cl.[7] ..... B41J 29/02

(52) U.S. Cl. ..... 400/692; 400/691; 400/693; 400/624

(58) Field of Search ..... 347/104, 22; 400/624, 400/625, 626, 627, 628, 629, 690, 691, 692, 693

(56) References Cited

U.S. PATENT DOCUMENTS 4,698,650 A * 10/1987 Watanabe et al. ..... 346/124
5,103,244 A * 4/1992 Gast et al. ..... 347/33
5,152,622 A * 10/1992 Rasmussen et al. .... 400/624 X
5,180,232 A * 1/1993 Chardima, Jr. et al. . 400/691 X
5,186,558 A * 2/1993 Sherman et al. ..... 400/692
5,209,583 A * 5/1993 Lewis et al. ..... 400/88
5,372,512 A * 12/1994 Wilson et al. ..... 439/67
5,526,229 A * 6/1996 Wakabayashi et al. ..... 361/702
5,620,269 A * 4/1997 Gustafson ..... 400/624
5,746,528 A * 5/1998 Mayer et al. ..... 400/625
5,906,506 A * 5/1999 Chang et al. ..... 439/501 X
6,106,178 A * 8/2000 Chiu ..... 400/624
6,120,201 A * 9/2000 McKay et al. ..... 400/691
6,132,122 A * 10/2000 Robinson et al. ..... 400/124

* cited by examiner

*Primary Examiner*—Andrew H. Hirshfeld
*Assistant Examiner*—Minh H. Chau

(57) ABSTRACT

The present invention is a removable paper module for use in a printer. The printer is a low-height, narrow-width printer used in home entertainment units. The removable paper module contains both an input tray to hold input media and an output tray to hold printed media and is inserted into the printer via the front plane of the printer. When clearing paper jams, the module is removed simultaneously by removing the input and output trays. When loading input media and retrieving printed media from the printer, the proper tray may be singularly removed.

17 Claims, 3 Drawing Sheets

REMOVABLE PAPER MODULE FOR AN ORTHOGONAL INKJET PRINTER

BACKGROUND OF THE INVENTION

1. Field of the Invention

The invention relates generally to printers, and more particularly, to a removable paper tray module used in a low-profile inkjet printer.

2. Related Art

Digital set-top boxes (e.g., cable television boxes, Internet terminal boxes etc.) are being used increasingly with consumer home entertainment equipment such as television sets, videocassette recorders, digital video disc (DVD) players and the like. In many cases, it is desirable for a user to obtain a hard copy of information displayed on the screen of their television sets. Specifically, users typically want to print e-mail messages, maps, recipes and information-rich content, such as still or captured scenes from live broadcasts, DVD players, movie cameras, video recorders etc.

Currently, if a user wants to have a hardcopy of the displayed information, the user has to use a conventional printer. Most conventional printers, however, are bulky, and thus require large amounts of space in users' home entertainment units. Hence, a printer specifically designed for use in home entertainment units is needed (i.e., a living room printer).

The living room printer should be of low height (i.e., low profile) and relatively narrow in width to blend in with other home entertainment equipment. In addition, since home entertainment equipment is usually stacked one atop another in home entertainment units, user access to the living room printer should preferably be through a front plane of the printer similar to video cassette players.

Due to the low profile requirement of the living room printer, however, front plane user access may be very restricted. For example, many conventional inkjet print engines contain three primary components, which are generally organized in series. Some of these components include the platen and service station. The platen has a printing area where print media (i.e., paper) are printed upon. The service station includes a spittoon receptacle in which print drops are disposed to clear the nozzles. The service station also contains a wiper to wipe clean the printhead during use and a cap to prevent the printhead from drying out during periods of non-use.

The inkjet print engines, including printheads, are usually placed at the back plane of conventional inkjet printers. But, placing the print engine and printhead at the back plane of the living room printer will not allow for enough space for an input paper tray to hold input print media and an output paper tray to hold output (printed) media without violating either the low profile or the front panel user access requirement of the living room printer. Thus, what is needed is a printer that has the print engine and printhead placed on one side of the printer (i.e., placed orthogonally to the front plane of the printer), so that both the low profile and front plane user access requirements of the living room printer are met.

Additionally, conventional inkjet printers typically have the input and output paper trays completely independent of each other. That is, either tray can be removed and reinserted into the printer without the other being disturbed. The input and output trays of the living room printer should also be designed to be independent of each other. However, due to the low profile aspect of the living room printer, the space that would be made available by removing one of the trays might not be sufficient for clearing paper jams. Hence, to maximize the space available for user access, both trays have to be removed. As a convenience to the user, therefore, it would be desirable to allow both the input and output trays to be removed and reinserted simultaneously into the printer.

Consequently, what is needed is a printer having an orthogonally placed inkjet print engine and input and output trays capable to be removed and reinserted simultaneously.

SUMMARY OF THE INVENTION

To overcome the limitations of the systems and methods described above, and to overcome other limitations that will become apparent upon reading and understanding the present specification, the present invention is embodied in a low-profile, narrow-width printer having a removable paper module. The removable paper module contains both an input tray to hold input media and an output tray to hold printed media. The removable paper module is inserted into the printer via the front plane of the printer. To provide adequate space for clearing paper jams, the module is removed simultaneously by removing both the input and output trays. But, to load input media into the printer or to retrieve printed media from the printer, the respective tray can be singularly removed as in conventional printers.

To maintain the low profile requirement of the printer, the print engine mechanism, including printheads, is disposed orthogonally to the front plane of the printer. As a result, the input media and printed media are also disposed orthogonally into the printer thereby reducing the complexity of the print engine mechanism.

The present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings, which form a part hereof, and in which is shown by way of illustration a specific embodiment in which the invention may be practiced. It is to be understood that other embodiments may be utilized and structural changes may be made without departing from the scope of the present invention.

Overview

Figure 1:
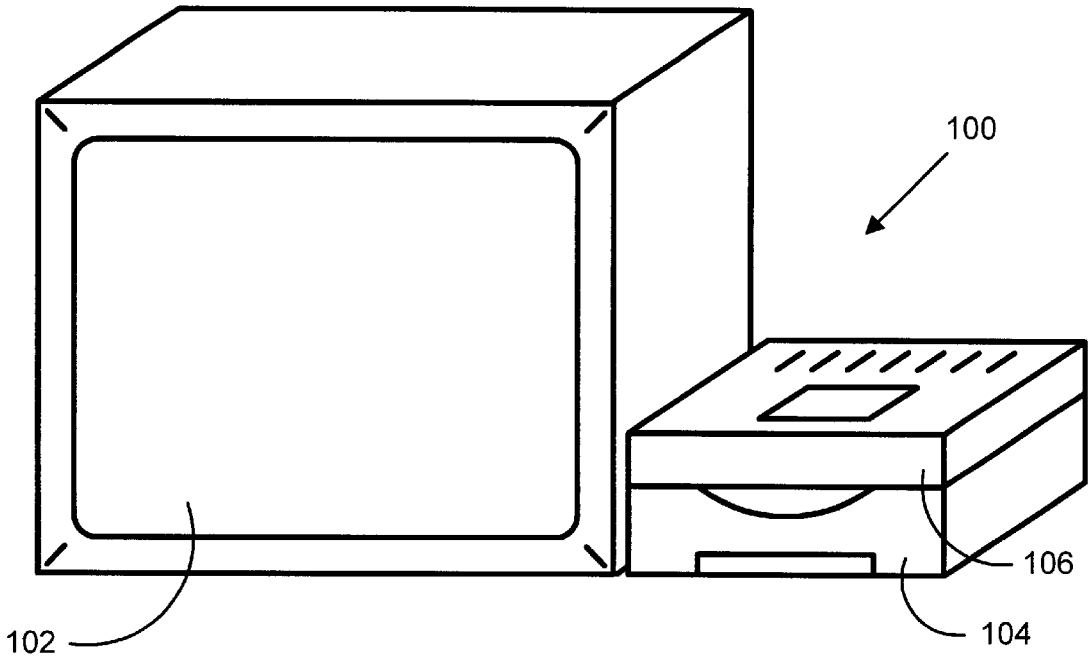
FIG. 1 depicts an overview block diagram of a home entertainment system that includes the living room printer of the present invention.

As shown in the drawings for purposes of illustration, FIG. 1 depicts an overview block diagram of a home entertainment system 100 of the present invention. Namely, the system 100 includes a television set 102, a living room printer 104 and a set-top box 106. The living room printer 104 and set-top box 106 may be placed one on top of the other on the television set 102.

The set-top box 106 is electronically connected to the television set 102 via any suitable manner, such as a coaxial cable (not shown). The set-top box 106 is also connected to the printer 104 via a printer cable or ribbon (not shown). The set-top box 106 may contain at least a processor (not shown) to process data and a non-volatile memory (also not shown) for storing software programs including a printer driver. The set-top box may also contain a connector or some sort of suitable mechanism to download or update software programs.

As previously mentioned, currently for printing purposes, problems exist when a user desires a hard copy of the information displayed on the television screen. Although conventional printers can be manually connected to some set-top boxes, most conventional printers are bulky, and thus require large amounts of space in users' home entertainment units. In addition, most conventional printers do not match the decor of entertainment equipment. The living room printer 106 in accordance with the present invention solves these problems.

Component Details and Operation

Figure 2:
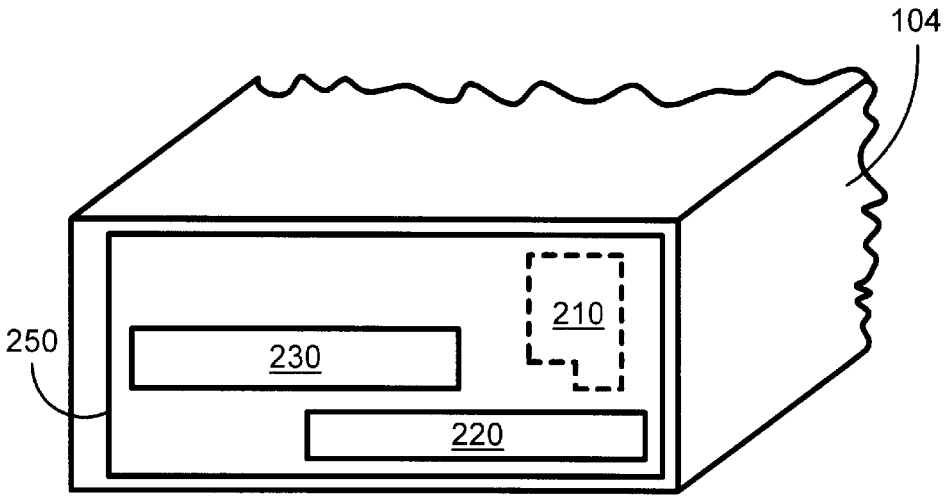
FIG. 2 illustrates a cut-away perspective view of a front portion of the printer of the present invention.

FIG. 2 illustrates a cut-away perspective view of a front portion of the living room printer 104 of FIG. 1. As shown in FIG. 2, in the front plane of the printer are located removable module 250, input tray 220 and output tray 230. Loading input media into the printer involves removing input tray 220, placing input media, such as paper, into the input tray 220 and reinserting the input tray 220 into the printer 104. To retrieve printed media, output tray 230 can be removed or a slot (not shown) can be used to receive ejected media. However, to clear paper jams or to remove a printhead system 210, such as inkjet print cartridges (shown in FIG. 2 with shadow lines), the module 250 is removed. When module 250 is removed, both input tray 220 and output tray 230 are simultaneously removed from the printer allowing enough space to perform the task at hand. Module 250, input tray 220 and output tray 230 can all be on slides or on rollers or any other suitable means or combination thereof to facilitate their removal and reinsertion into the printer 104.

Figure 3:
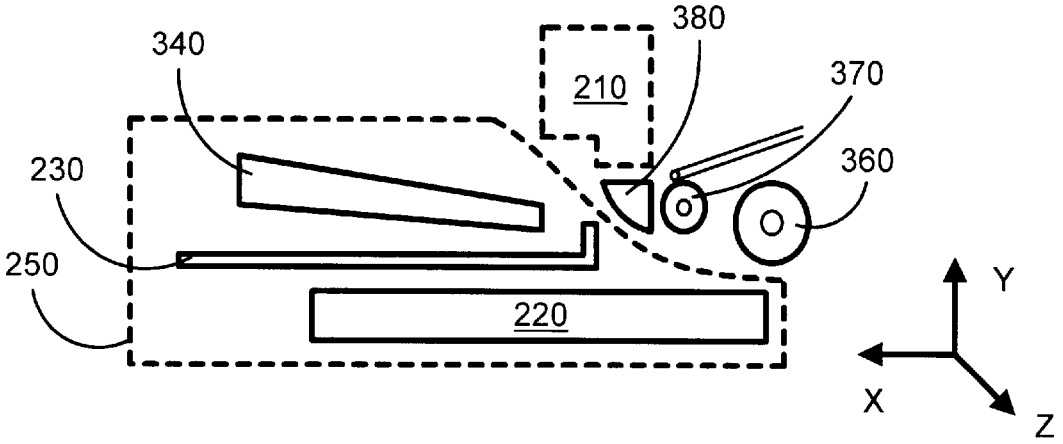
FIG. 3 illustrates a cross-sectional view of the living room printer of the present invention.

FIG. 3 illustrates a front cross-sectional view of the living room printer 104. Shown in FIG. 3 are the inkjet printhead system 210, the removable input tray 220, and the removable output tray 230. The removable output tray 230 preferably includes an output media handling device 340. The media handling device 340 can be any suitable device, such as a conventional output wing, which allows a freshly printed image on a single medium, such as a sheet of paper, to be temporarily held before being stacked on top on a previously printed medium in the output tray 230. Temporarily holding the freshly printed media in the media handling device 340 allows the ink on the previous printed media to dry, thereby avoid ink smearing. The media handling device 340 also neatly stacks the printed media in the output tray 230.

Shown in shadow lines is the removable module 250. The removable module 250 as well as the input tray 220 and output tray 230 are removed from the living room printer 104 in a direction Z perpendicular to the X, Y plane of the sheet on which FIG. 3 is depicted. Also shown in FIG. 3 are pick roller 360, which is used to grasp each single print medium from the input tray 220, feed roller 370 to feed the print medium and platen 380 to facilitate printing on the print medium.

Figure 4:
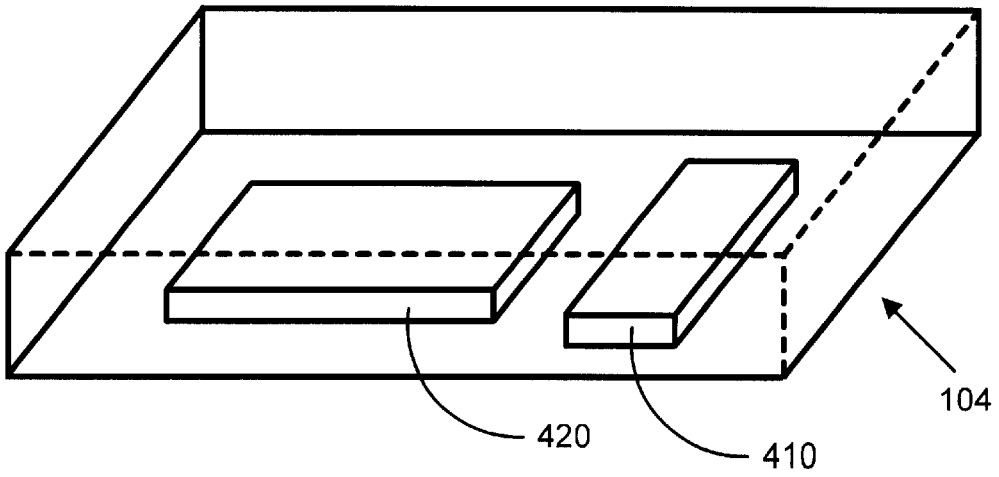
FIG. 4 depicts a top cross-sectional view of the living room printer of the present invention.

FIG. 4 depicts a top cross-sectional view of the living room printer 104 of the present invention. This figure illustrates the location of a print engine mechanism 410 (which can include components such as the pick roller 360, the feed roller 370, printhead 210, platen 380) in relation to the placement of print media 420. The print engine mechanism 410 can be disposed in the printer 104 in a direction orthogonal to the front plane of the printer. Print media 420 are also orthogonally inserted into the printer 104. That is, the width of the print media 420 resides from the front to the rear of the printer whereas the length of the media 420 runs parallel to the front and back planes of the printer 104. This orthogonal configuration facilitates the placement of the input tray 220 and the output tray 230 through the front plane of the printer without violating either the low profile or the user front access requirement of the living room printer 104.

Figure 5:
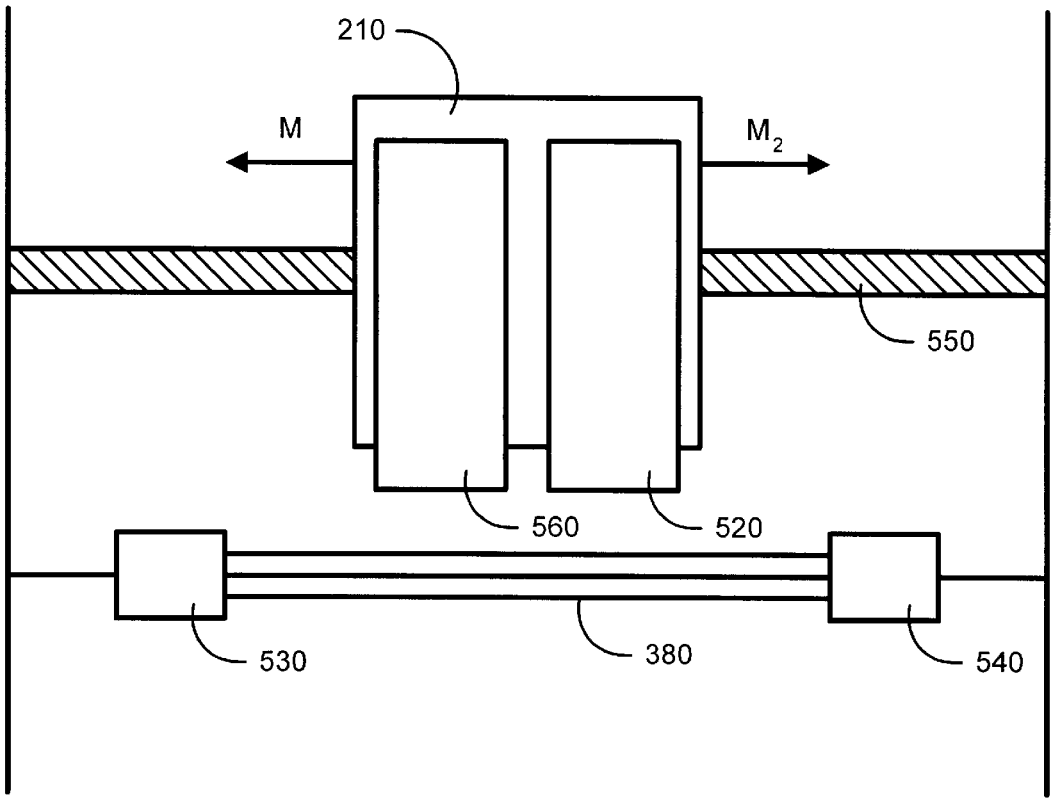
FIG. 5 illustrates a cross-sectional view of the print engine of the living room printer of the present invention.

FIG. 5 illustrates a cross-sectional view of the print engine of the living room printer 104. The inkjet printhead system 210 preferably comprises a carriage that contains multiple printheads or print cartridges 510 and 520. One of the print cartridges can be a multi-color ink cartridge and the other can be a black ink cartridge. Note that it is possible to use only a multi-color cartridge to print in either black and white or in color. Separate print cartridges for black and color can be provided to allow individual control of ink usage.

As such, the printer can have either a single cartridge, such as a black or a multi-color cartridge, or multiple cartridges, such as a multicolor ink cartridge to print in color and a black ink cartridge to print in black and white. However, for the single cartridge case, if the black ink cartridge or the multi-color ink cartridge is not already in the printer when a user wants to print in black and white or in color, respectively, the user has to intervene to switch from a black to a multi-color ink cartridge. Thus, having both a multi-color and a black ink cartridge allows the printer to print in either color or black and white without user intervention to switch from a black ink cartridge to a multi-color cartridge or vice versa before printing.

The carriage is preferably mounted on a slider rod 550 to carry print cartridges 510 and 520 in the direction indicated by arrows M and Ml, this direction is perpendicular to the direction of movement of the print media 420 of FIG. 4. That is, this direction is from the rear of the printer to the front of the printer and vice versa. Travel of the carriage along the slider rod 550 is controlled in a conventional manner by a carriage drive motor (not shown).

Also shown in FIG. 5 are service stations 530 and 540. Service stations 530 and 540 contain capping stations, spittoons and wipers etc., as described in pending U.S. patent application Ser. No. 09/115,153 entitled PRINTHEAD SERVICING TECHNIQUE, filed on Jul. 14, 1998 by Gaarder, the disclosure of which is hereby incorporated by reference.

One advantage of having service station 530 on one side and service station 540 on the other side of the platen 380 is that the printer can be of a smaller depth. For example, conventionally spittoon stations and service stations for both cartridges are placed on one side of the platen. Thus, both cartridges have to clear the platen when one is being serviced. In this embodiment, however, only the cartridge in use needs to clear the platen to be serviced; thus minimizing the cartridges excursion past the platen. This, in turn, allows for a printer of a yet smaller depth.

Referring back to FIGS. 3 and 4, in operation, each single print medium 420 from the input tray 220 is picked up by pick roller 360 and moved toward the right side of the printer and through a U-shaped track (not shown). The U-shaped tract redirects the movement of each print medium 420 toward feed roller 370. Feed roller 370 then feeds each print medium 420 over platen 380 and inkjet printhead system 210 prints on each print medium 420. Once printing on a single print medium is terminated, the print medium is sent to the output media handling device 340 where it is held temporarily to allow the ink on the previously printed medium, now in the output tray 230, to dry. After being held temporarily in the output media handling device 340 and before printing on the succeeding print medium is terminated, the print medium is neatly placed on top of the previous printed medium in output tray 230.

The description of the present invention has been presented for purposes of illustration and description, but is not intended to be exhaustive or limited to the invention in the form disclosed. Many modifications and variations will be apparent to those of ordinary skill in the art. For example, the printer need not be an inkjet printer. Therefore, the foregoing description should not be taken as limiting the scope of the invention defined by the appended claims.

What is claimed is:

1. A printer having a frontal access area comprising:

a removable module having an input tray for holding print media, an output tray for holding printed media and a media handling device that temporarily holds the printed media while printed ink on the printed media dries and then neatly stacks the printed media in the output tray after the ink dries, wherein the removable module is removable from the printer via the frontal access area;

a platen having a print area where the print media are printed upon; and a print engine mechanism disposed orthogonally to a front plane of the frontal access area of the printer wherein a width of the print media resides from the front to a rear of the printer and a length of the print media is parallel to the front and back planes of the printer to enable the print engine to traverse perpendicular to the direction of movement of the print media.

2. The printer of claim 1 wherein both the input tray and the output tray may be simultaneously removed or reinserted into the printer by removing or reinserting the module into the printer, respectively.

3. The printer of claim 2 wherein the input tray or the output tray may be singularly removed or reinserted into the printer.

4. The printer of claim 3 wherein the print media is loaded orthogonally into the printer.

5. The printer of claim 4 wherein printed media are stored orthogonally in the printer.

6. The printer of claim 5 further comprising two service stations having each a wiper, a spittoon and a cap, each service station being located at one side of the platen.

7. The printer of claim 6 wherein the printer has a color ink printhead and a black ink printhead.

8. A printer having a frontal access area for use in a home entertainment unit comprising:

a removable module having an input tray for holding print media, an output tray for holding printed media and a media handling device that holds the printed media while ink that was printed on printed media dries and then stacks the printed media in the output tray after the ink dries, wherein the removable module is removable from the printer via the frontal access area;

a platen having a print area where the print media are printed upon;

two service stations one for servicing a first printhead for printing in black and white and one for servicing a second printhead for printing in color, each one of the two service stations being disposed at one side of the platen; and a print engine mechanism disposed orthogonally to a front plane of the frontal access area of the printer wherein a width of the print media resides from the front to a rear of the printer and a length of the print media is parallel to the front and back planes of the printer to enable the print engine to traverse perpendicular to the direction of movement of the print media.

9. The printer of claim 8 wherein both the input tray and the output tray may be simultaneously removed or reinserted into the printer by removing or reinserting the module into the printer, respectively.

10. The printer of claim 9 wherein the input tray or the output tray may be singularly removed or reinserted into the printer.

11. The printer of claim 10 wherein the print media is loaded orthogonally into the printer.

12. The printer of claim 11 wherein the printed media are stored orthogonally in the printer.

13. The printer of claim 12 wherein each one of the two service stations has a wiper, a spittoon and a cap.

14. The printer of claim 8 further comprising first and second printheads for printing on the print media, wherein the first printhead prints in black and white and the second printhead prints in color.

15. A low-profile, narrow-width printer having a frontal access area for use in a home entertainment unit comprising:

a removable module having an input tray for holding print media, an output tray for holding printed media and a media handling device that temporarily holds printed media until ink printed on the printed media dries and then neatly stacks the printed media in the output tray after the ink dries, the input tray and the output tray being able to be simultaneously removed or reinserted into the printer by removing or reinserting the module into the printer, wherein the removable module is removable from the printer via the frontal access area;

a platen having a print area where the print media are printed upon;

multi-service stations, each being disposed at a side of the platen and wherein each service station services an associated printhead; and a print engine mechanism disposed orthogonally to a front plane of the frontal access area of the printer wherein a width of the print media resides from the front to a rear of the printer and a length of the print media is parallel to the front and back planes of the printer to enable the print engine to traverse perpendicular to the direction of movement of the print media.

16. The printer of claim 15 wherein at least one of the input tray and the output tray are singularly removed or reinserted into the printer.

17. The printer of claim 15 further comprising first and second printheads for printing on the print media, wherein the first printhead prints in black and white and the second printhead prints in color.

* * * * *

UNITED STATES PATENT AND TRADEMARK OFFICE

CERTIFICATE OF CORRECTION

PATENT NO. : 6,428,228 B1
DATED : August 6, 2002
INVENTOR(S) : McKay et al.

It is certified that error appears in the above-identified patent and that said Letters Patent is hereby corrected as shown below:

Title page,
Item [75], Inventors, "Kilne" should read -- Kline --.

Signed and Sealed this

Thirteenth Day of July, 2004

JON W. DUDAS
*Acting Director of the United States Patent and Trademark Office*